US011311889B2

(12) United States Patent
Höglund

(10) Patent No.: US 11,311,889 B2
(45) Date of Patent: Apr. 26, 2022

(54) CENTRIFUGAL SEPARATOR AND METHOD FOR ELIMINATING AIR LOCKS IN A CENTRIFUGAL SEPARATOR

(71) Applicant: ALFA LAVAL CORPORATE AB, Lund (SE)

(72) Inventor: Kasper Höglund, Rönninge (SE)

(73) Assignee: ALFA LAVAL CORPORATE AB, Lund (SE)

( * ) Notice: Subject to any disclaimer, the term of this patent is extended or adjusted under 35 U.S.C. 154(b) by 0 days.

(21) Appl. No.: 17/296,382

(22) PCT Filed: Dec. 9, 2019

(86) PCT No.: PCT/EP2019/084138
§ 371 (c)(1),
(2) Date: May 24, 2021

(87) PCT Pub. No.: WO2020/120358
PCT Pub. Date: Jun. 18, 2020

(65) Prior Publication Data

US 2022/0023885 A1 Jan. 27, 2022

(30) Foreign Application Priority Data

Dec. 10, 2018 (EP) ..... 18211238

(51) Int. Cl.
*B04B 1/08* (2006.01)
*B04B 5/04* (2006.01)
*B04B 7/14* (2006.01)

(52) U.S. Cl.
CPC ..... *B04B 1/08* (2013.01); *B04B 5/0442* (2013.01); *B04B 7/14* (2013.01)

(58) Field of Classification Search
CPC ..... B04B 1/08; B04B 5/0442; B04B 7/14
(Continued)

(56) References Cited

U.S. PATENT DOCUMENTS 727,052 A 5/1903 Anderson
919,131 A 4/1909 Collins et al.
(Continued)

FOREIGN PATENT DOCUMENTS

DE 10 2009 053 660 B3 5/2011
GB 11744 11/1909
(Continued)

OTHER PUBLICATIONS

International Search Report, issued in PCT/EP2019/084138, dated Jan. 20, 2020.
(Continued)

*Primary Examiner* — Walter D. Griffin
*Assistant Examiner* — Shuyi S. Liu
(74) *Attorney, Agent, or Firm* — Birch, Stewart, Kolasch & Birch, LLP

(57) ABSTRACT

A centrifugal separator bowl includes a rotor casing enclosing a separation space in which a stack of frustoconical separation discs is arranged to rotate around a vertical axis of rotation, wherein the separation discs are arranged with the imaginary apex pointing to the axially lower end of the rotor casing; a feed inlet at the axially lower end for receiving the fluid mixture to be separated; a distributor for distributing the fluid mixture from the inlet to the separation space, the distributor being arranged for guiding the fluid mixture to be separated continuously from an axially lower position at the inlet to an axially upper position in the separation space. The separator bowl further includes a light phase outlet for discharge of a separated phase of a first density and a heavy phase outlet for discharge of a separated phase of a second density higher than the first density, the heavy phase outlet being arranged at the axially upper end of the rotor casing; at least one outlet conduit for transporting separated phase of the second density from the separa-
(Continued)

tion space, the conduit extending from a radially outer position of the separation space to the heavy phase outlet; the conduit having a conduit inlet arranged at the radially outer position and a conduit outlet at a radially inner position.

20 Claims, 3 Drawing Sheets

(58) Field of Classification Search
USPC ..... 233/19; 494/38, 44, 63, 68, 74
See application file for complete search history.

(56) References Cited

U.S. PATENT DOCUMENTS 1,968,788 A * 7/1934 Tomlinson ..... B04B 1/08 494/44
2,104,683 A 1/1938 Rosen et al.
3,602,425 A 8/1971 Schmidt et al.
3,750,940 A * 8/1973 Nilsson ..... B04B 13/00 494/3
5,180,358 A * 1/1993 Pace ..... B04B 1/08 494/48
6,439,577 B2 8/2002 Jorgensen et al.
6,709,377 B1 3/2004 Rochat
6,821,319 B1 11/2004 Moberg et al.
7,037,428 B1 5/2006 Robinson et al.
2011/0319248 A1 12/2011 Starbard
2016/0184836 A1 6/2016 Mackel et al.
2017/0189915 A1 7/2017 Mackel et al.
2017/0203306 A1* 7/2017 Penkl ..... B04B 7/02
2018/0147581 A1 5/2018 Quiter et al.

FOREIGN PATENT DOCUMENTS

GB 1027541 A * 4/1966 ..... A23L 2/12
WO WO 2008/106409 A1 9/2008
WO WO 2014/000829 A1 1/2014
WO WO 2015/181175 A2 12/2015
WO WO 2015/181177 A1 12/2015
WO WO 2016/192927 A1 12/2016
WO WO-2017144339 A1 * 8/2017 ..... B04B 11/04

OTHER PUBLICATIONS

Written Opinion of the International Searching Authority, issued in PCT/EP2019/084138, dated Jan. 20, 2020.

* cited by examiner

CENTRIFUGAL SEPARATOR AND METHOD FOR ELIMINATING AIR LOCKS IN A CENTRIFUGAL SEPARATOR

TECHNICAL FIELD

The present inventive concept relates to the field of centrifugal separators. More particularly it relates to a method for eliminating air locks in a centrifugal separator.

BACKGROUND

Centrifugal separators are generally used for separation of liquids and/or solids from a liquid mixture or a gas mixture. During operation, fluid mixture that is about to be separated is introduced into a rotating bowl and due to the centrifugal forces, heavy particles or denser liquid, such as water, accumulates at the periphery of the rotating bowl whereas less dense liquid accumulates closer to the central axis of rotation. This allows for collection of the separated fractions, e.g. by means of different outlets arranged at the periphery and close to the rotational axis, respectively.

When processing pharmaceutical products such as fermentation broths, it may be desirable to eliminate the need for cleaning-in-place processes of the rotating bowl and the separator parts that have contacted the processed product. More useful may be to exchange the rotating bowl as a whole, i.e. to use a single use solution. This is advantageous from a hygienic perspective of the process.

WO 2015/181177 discloses a separator for the centrifugal processing of a flowable product comprising a rotatable outer drum and an exchangeable inner drum arranged in the outer drum. The inner drum comprises means for clarifying the flowable product. The outer drum is driven via drive spindle by a motor arranged below the outer drum. The inner drum extends vertically upwardly through the outer drum which has fluid connections arranged at an upper end of the separator.

However, when using a separator with a single use insert, several issues may arise. One such issue is that low pressures are used. That means that common methods to remove trapped air in the centrifuge are not applicable. Air locks cannot be compressed by external pressure nor be removed by intermittent discharge of the separator rotor bowl. Thus, there is a need in the art for improved ways for venting or eliminating air in a centrifugal separator, and especially for a centrifugal separator that is for use in single use applications.

SUMMARY

It is an object of the invention to at least partly overcome one or more limitations of the prior art. In particular, it is an object to provide a centrifugal separator bowl that facilitates an easy removal of trapped air.

As a first aspect of the invention, there is provided a centrifugal separator bowl comprising a rotor casing enclosing a separation space in which a stack of frustoconical separation discs is arranged, the rotor casing being arranged to rotate around a vertical axis (X) of rotation, wherein the separation discs are arranged with the imaginary apex pointing to the axially lower end of the rotor casing;

a feed inlet at the axially lower end for receiving the fluid mixture to be separated;

a distributor for distributing the fluid mixture from the inlet to the separation space, said distributor being arranged for guiding the fluid mixture to be separated continuously from an axially lower position at the inlet to an axially upper position in the separation space;

a light phase outlet for discharge of a separated phase of a first density and a heavy phase outlet for discharge of a separated phase of a second density higher than said first density, said heavy phase outlet being arranged at the axially upper end of the rotor casing;

at least one outlet conduit for transporting separated phase of the second density from the separation space, said conduit extending from a radially outer position of said separation space to said second liquid outlet; said conduit having a conduit inlet arranged at the radially outer position and a conduit outlet at a radially inner position.

The rotor casing encloses a separation space in which the separation of the fluid mixture, such as a gas mixture or a liquid mixture, takes place. The rotor casing may be a rotor casing and be free of any further outlets for separated phases. Thus, the rotor casing may be solid in that it is free of any peripheral ports for discharging e.g. a sludge phase accumulated at the periphery of the separation space. However, in embodiments, the rotor casing comprises peripheral ports for intermittent or continuous discharge of a separated phase from the periphery of the separation space.

In embodiments of the first aspect of the invention, the rotor casing is free of any further outlets for separated phases.

Thus, the rotor casing may be solid in that it is free of any peripheral ports for discharging e.g. a sludge phase accumulated at the periphery of the separation space. Thus, the exchangeable insert may comprise solely the light phase and the heavy phase outlet.

In embodiments of the first aspect of the invention, the separation space extends from a first axial position to a second axial position, and wherein the inner diameter of the separation space continuously increases from said first to said second axial position. As an example, the heavy phase collection space of the separation space may extend from a first axial position to a second axial position, and the inner diameter of the separation space may continuously increase from said first to said second axial position. The separation space may thus comprise a heavy phase collection space, which is a space that is radially outside the stack of separation discs. The separation space may also comprise a radially inner portion, which is thus formed by the interspaces between the discs of the stack of separation discs.

Thus, the inner surface of the separation space may gradually increase in an axial direction. As an example, the first axial position may be closer to the inlet and the second axial position may be closer to the outlets. A continuous increase of the inner diameter, with no intermittent decrease, may facilitate collection of the separated heavy phase at the second axial position of the separation space.

The separation space comprises a stack of separation discs arranged centrally around the axis of rotation. The separation discs have a frustoconical shape, which refers to a shape having the shape of a frustum of a cone, which is the shape of a cone with the narrow end, or tip, removed. A frustoconical shape has thus an imaginary apex where the tip or apex of the corresponding conical shape is located. The imaginary apex of the frustoconical separation discs points towards the lower axial end of the separator bowl.

The axis of the frustoconical shape is axially aligned with the rotational axis of the rotor casing. The axis of the frustoconical portion is the direction of the height of the corresponding conical shape or the direction of the axis passing through the apex of the corresponding conical shape.

The separation discs may e.g. comprise a metal or be of metal material, such as stainless steel. The separation discs may further comprise a plastic material or be of a plastic material.

The feed inlet is for receiving the fluid mixture to be separated from a stationary inlet pipe, and the distributor is for guiding the received fluid, such as a liquid, to the separation space. The distributor may thus be arranged at the inlet.

The distributor is further arranged to guide the fluid to be separated upwards to the separation space, i.e. from an axially lower position at the inlet to an axially upper position in the separation space. The distributor is arranged to guide the fluid upwards without any interruptions, i.e. the fluid is guided up to the separation space without being guided towards the axially lower end.

The light phase outlet is for discharging a separated phase of a lower density and the heavy phase outlet is for separating a phase of a higher density. The heavy phase outlet is arranged at the upper axial end of the rotor casing. The light phase outlet may be arranged at the lower axial end or at the upper axial end of the rotor casing.

There is further at least one outlet conduit arranged for transporting a separated heavy phase from the separation space to the heavy phase outlet. The at least one conduit extends from a radially outer position in the separation space to the heavy phase outlet, which is thus at a radially inner position. The conduit has a conduit inlet arranged at the radially outer position and a conduit outlet at a radially inner position. Further, the at least one outlet conduit is arranged with an upward tilt from the conduit inlet to the conduit outlet. Thus, relative the radial plane, the conduit is tilted axially upwards from the conduit inlet in the separation space to the conduit outlet at the heavy phase outlet. This may facilitate transport of the separated heavy phase in the conduit.

The conduit inlet may be arranged at an axially upper position in the separation space. The conduit inlet may be arranged at an axial position where the separation space has it largest inner diameter.

The outlet conduit may be a pipe. As an example, the rotor casing may comprise a single outlet conduit.

In embodiments, the at least one outlet conduit is arranged with an upward tilt from the conduit inlet to the conduit outlet.

In embodiments of the first aspect of the invention, the at least one outlet conduit is tilted with an upward tilt of at least 2 degrees relative the radial plane. As an example, the at least one outlet conduit may be tilted with an upward tilt of at least 5 degrees, such as at least 10 degrees, relative the radial plane.

The at least one outlet conduit may facilitate transport of the separated heavy phase in the separation space to the heavy phase outlet.

The first aspect of the invention is based on the insight that by arranging the inlet, distributor, separation discs and the outlet conduit as disclosed above, the centrifugal separator bowl is de-aerated automatically, i.e. the presence of air-pockets is eliminated or decreased so that any air present within the rotor casing is forced to travel unhindered upwards and out via the heavy phase outlet. Consequently, the design of the separator bowl as according to the first aspect of the invention provides for a bowl that is vented automatically. For example, if the bowl is filled up through the feed line, all air may be vented out through the heavy phase outlet.

According to embodiments, the distributor and the inlet are arranged to guide the fluid mixture to be separated solely along an upwards path from the stationary inlet conduit to the separation space. This means that air may easily escape via the outlet conduit and out via the heavy phase outlet.

Thus, the inlet, distributor, separation space, outlet conduit and heavy phase outlet are arranged so that they form a fluid path that extends solely axially upwards from the inlet to the heavy phase outlet. This is advantageous in that it minimizes the risk of air-pockets or air-locks within the separator. Such air locks may severely decrease the functionality and separation capacity and create unwanted air-liquid interphases during operation.

In embodiments of the first aspect, the feed inlet is at the rotational axis (X).

Furthermore, also the heavy phase outlet may be arranged at the rotational axis (X).

This may be advantageous in that it provides for a gentler treatment of the separated heavy phase. If the heavy phase is discharged at a small radius from the rotational axis (X), the rotational forces are fewer. This may be an advantage e.g. when separating a cell culture. Such cells may be shear sensitive, so it may be advantageous to be able to discharge them at a small diameter from the rotational axis.

Furthermore, it may be advantageous in allowing both the inlet and a liquid outlet to be arranged at the axis of rotation (X).

In embodiments of the first aspect, the centrifugal separator bowl is further comprising a mechanical hermetic seal for sealing said inlet to a stationary inlet pipe.

The inlet pipe may thus also be arranged at the rotational axis (X).

The mechanical hermetic seal is a rotatable seal for connecting and sealing the inlet to a stationary inlet pipe. A hermetic seal refers to a seal that is supposed to give rise to an air tight seal between a stationary portion and the rotor casing and prevent air from outside the rotor casing to contaminate the feed. Therefore, the rotor casing may be arranged to be completely filled with liquid during operation. This means that no air or free liquid surfaces is meant to be present in the rotor casing during operation.

This seal may be arranged at the border of the rotor casing and a stationary portion and may thus comprise a stationary part and a rotatable part.

Thus in embodiments, the mechanical hermetic seal comprises a stationary part arranged in a stationary portion and a rotatable part arranged in the axially lower end of the rotor casing.

Further, the rotatable part of the first rotatable seal may be arranged directly onto the axially lower portion of the rotor casing. In embodiments of the first aspect of the invention, the distributor is arranged to guide the fluid mixture to an axially upper position in the separation space, which is at a radial position that is outside the radial position of the outer circumference of the stack of frustoconical separation discs.

Liquid or fluid to be separated may thus be supplied to the separation space radially outside of the stack of separation discs.

However, the distributor may also be arranged to supply the liquid or fluid to be separated to the separation space at a radial position that is within the stack of separation discs, e.g. by axial distribution openings in the distributor and/or the stack of separation discs. Such openings may form axial distribution channels within the stack.

Furthermore, the stack of separation discs may form a stack on top of the distributor. The distributor may thus function as a support for the stack of separation discs. This may save space in the rotor casing.

Moreover, the distributor may have a conical outer surface with the apex pointing toward the axial lower end of the centrifugal rotor.

The conical outer and lower surface of the distributor may thus have the same angle relative the rotational axis as the separation discs. In the stack of separation discs. The conical shape of the distributor may have a diameter that is about the same or larger than the outer diameter of the separation discs in the stack.

The distributor may further comprise distribution channels arranged for guiding the fluid mixture to be separated continuously from an axially lower position at the inlet to an axially upper position in the separation space.

The distribution channels may for example be straight or curved. The distribution channels may further have a constant channel width or be diverging.

Furthermore, the distribution channels may extend along the outer surface of the distributor. The outer, and lower, surface of the distributor, as well as the distribution channels, may thus tilt upwards from the inlet to the separation space, thereby guiding the fluid mixture to be separated continuously from an axially lower position at the inlet to an axially upper position in the separation space.

In embodiments of the first aspect of the invention, the separator bowl forms part of an exchangeable separation insert for a centrifugal separator.

The exchangeable separation insert may thus be a pre-assembled insert ready for being inserted into a rotatable member, which may include rotatable support for the insert. Such a rotating assembly may also comprise a drive unit for rotating the rotatable member around the axis of rotation (X).

According to embodiments, the exchangeable separation insert is a single use separation insert. Thus, the insert may be adapted for single use and be a disposable insert. The exchangeable insert may thus be for processing of one product batch, such as a single product batch in the pharmaceutical industry, and then be disposed.

It is advantageous to have a self-deaerated insert in single use or pharmaceutical applications, since you may be prevented to open up the insert to get rid of air for hygienic reasons.

The exchangeable separation insert may comprise a polymeric material or consist of a polymeric material. As an example, the rotor casing and the stack of separation discs may comprise, or be of a polymeric material, such as polypropylene, platinum cured silicone or BPA free polycarbonate. The polymer parts of the insert may be injection moulded. However, the exchangeable separation insert may also comprise metal parts, such as stainless steel. For example, the stack of separation discs may comprise discs of stainless steel.

The exchangeable insert may be a sealed sterile unit.

Further, if the centrifugal separator bowl is an exchangeable separation insert, the centrifugal bowl may be arranged to be solely externally supported by external bearings. Thus, the rotor casing, as well as the whole centrifugal separator bowl, may be free of any bearings.

Furthermore, the exchangeable separation insert may be free of any rotatable shaft that is arranged to be supported by external bearings.

Thus, as a configuration of the first aspect of the invention, there is provided a modular centrifugal separator configured for separating a liquid feed mixture into a heavy phase and light phase, the modular centrifugal separator comprising a base unit and an exchangeable separation insert, wherein the exchangeable separation insert comprises a centrifugal separator bowl as disclosed herein. The base unit may comprise a stationary frame, a rotatable member configured to rotate about an axis of rotation arranged in the stationary frame, and a drive unit for rotating the rotatable member about the axis of rotation. The rotatable member may have a first axial end and a second axial end, and may delimit an inner space at least in a radial direction, the inner space being configured for receiving at least one part of the exchangeable separation insert therein. The rotatable member may be provided with a first through opening to the inner space at the first axial end and configured for a first fluid connection of the exchangeable separation insert to extend through the first through opening. The rotatable member may also comprise a second through opening to the inner space at the second axial end and configured for a second fluid connection of the exchangeable separation insert to extend through the second through opening.

However, in embodiments of the first aspect of the invention, the centrifugal separator bowl is comprising a spindle arranged to rotate coaxially with said separator bowl and further arranged to be rotatably supported by a stationary frame.

Thus, as a configuration of the first aspect of the invention, there is provided a centrifugal separator for separating a fluid mixture, the centrifugal separator comprising a stationary frame, a spindle rotatably supported by the frame, a centrifugal separator bowl as disclosed above mounted to a first end of the spindle to rotate together with the spindle around an axis (X) of rotation. The centrifugal separator may further comprise drive means for rotating the centrifugal separator bowl around the axis of rotation.

As a second aspect of the invention, there is provided a method of separating a liquid mixture comprising a. providing a centrifugal separator comprising the centrifugal separator bowl according to any embodiment of the first aspect above;

b. supplying a liquid to said feed inlet at standstill and withdrawing liquid from said heavy phase outlet to eliminate any air-locks within said centrifugal separator bowl;

c. rotating said centrifugal separator bowl around the axis of rotation (X);

d. supplying said liquid mixture to be separated to said feed inlet.

The second aspect may generally present the same or corresponding advantages as the former aspect. The terms and definitions used in relation to the second aspect are the same as discussed in relation to the first aspect above.

The method of the second aspect is further advantageous in that liquid may be supplied at standstill of the separator bowl, i.e. when the centrifugal separator bowl does not rotate, in order to discharge any air present within the rotor casing out via the heavy phase outlet before rotation of the bowl.

In embodiments of the second aspect of the invention, the liquid mixture to be separated is a cell culture mixture.

The liquid supplied at standstill may be any type of liquid. As an example, if a cell culture is to be separated, the liquid supplied in step b) may be buffer liquid for the cell culture mixture.

In embodiments of the second aspect of the invention the liquid supplied in step b) is the liquid mixture to be separated. Thus, the liquid mixture to be separated may be supplied to the centrifugal separator bowl at standstill to eliminate air locks, and then the rotation of the centrifugal separator bowl may start when the liquid mixture to be separated is present within the centrifugal separator bowl.

As a third aspect of the invention there is provided a system for separating a cell culture mixture, comprising

- a centrifugal separator comprising the centrifugal separator bowl according to the first aspect of the invention;
- a fermenter for hosting a cell culture mixture;
- a connection from the bottom of the fermenter to the centrifugal separator arranged so that the cell culture mixture to be separated is supplied to the inlet at the axially lower end of the centrifugal separator bowl.

The fermenter may be a fermenter tank.

The connection may be any suitable connection, such as a pipe. The connection may be a direct connection between fermenter and the centrifugal separator.

BRIEF DESCRIPTION OF THE DRAWINGS

The above, as well as additional objects, features and advantages of the present inventive concept, will be better understood through the following illustrative and non-limiting detailed description, with reference to the appended drawings. In the drawings like reference numerals will be used for like elements unless stated otherwise.

DETAILED DESCRIPTION

Figure 1:
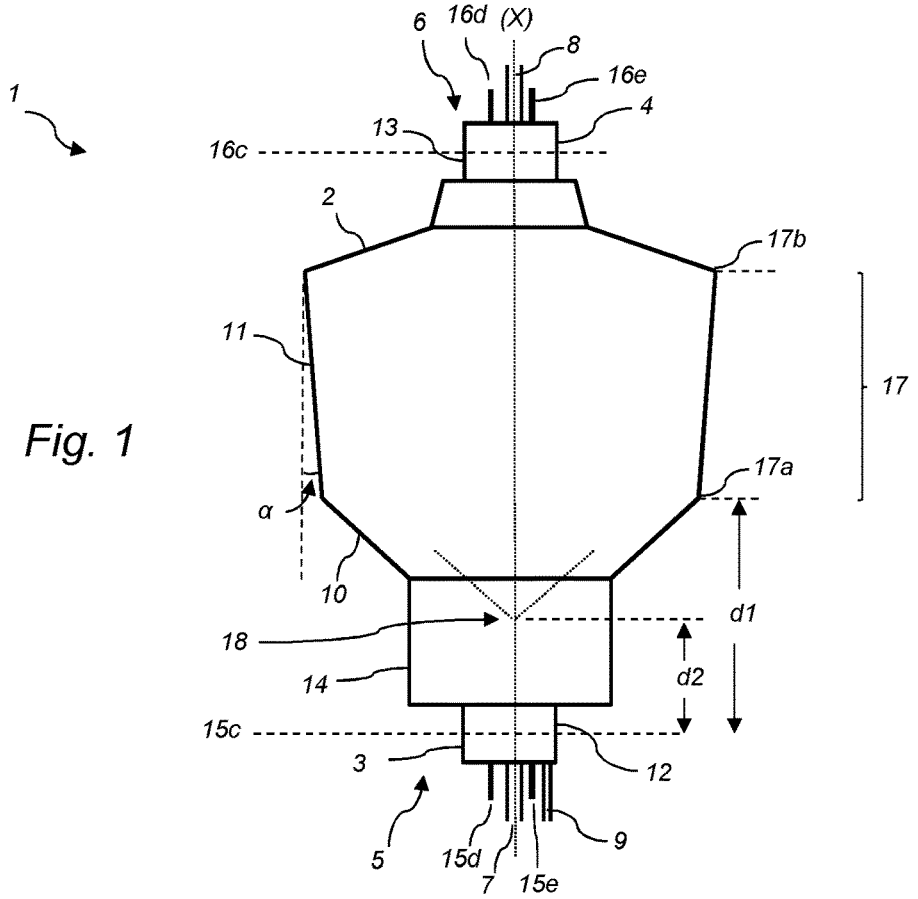
FIG. 1 is a schematic outer side view of a separator bowl in the form of an exchangeable separation insert according to the present disclosure.

FIG. 1 shows an outer side view of a centrifugal separator bowl 1 of the present disclosure in the form of an exchangeable separation insert 1. The insert 1 comprises a rotor casing 2 arranged between a first, lower stationary portion 3 and a second, upper stationary portion 4, as seen in the axial direction defined by rotational axis (X). The insert comprises the first stationary portion 3 which is arranged at the lower axial end 5 of the insert 1. The insert 1 comprises the second stationary portion 4 which is arranged at the upper axial end 6 of the insert 1.

The feed inlet is in this example arranged at the axial lower end 5, and the feed is supplied via a stationary inlet conduit 7 arranged in the first stationary portion 3. The stationary inlet conduit 7 is arranged at the rotational axis (X). The first stationary portion 3 further comprises a stationary outlet conduit 9 for the separated liquid phase of lower density, also called the separated liquid light phase.

There is further a stationary outlet conduit 8 arranged in the upper stationary portion 4 for discharge of the separated phase of higher density, also called the liquid heavy phase. Thus, in this embodiment, the feed is supplied via the lower axial end 5, the separated light phase is discharged via the lower axial end 5, whereas the separated heavy phase is discharged via the upper axial end 6.

The outer surface of the rotor casing 2 comprises a first 10 and second 11 frustoconical portion. The first frustoconical portion 10 is arranged axially below the second frustoconical portion 11. The outer surface is arranged such that the imaginary apex of the first 10 and second 11 frustoconical portions both point in the same axial direction along the rotational axis (X), which in this case is axially down towards the lower axial end 5 of the insert 1.

Furthermore, the first frustoconical portion 10 has an opening angle that is larger than the opening angle of the second frustoconical portion 11. The opening angle of the first frustoconical portion may be substantially the same as the opening angle of a stack of separation discs contained within the separation space 17 of the rotor casing 2. The opening angle of the second frustoconical portion 11 may be smaller than the opening angle of a stack of separation discs contained within the separation space of the rotor casing 2. As an example, the opening angle of the second frustoconical portion 11 may be such that the outer surface forms an angle $\alpha$ with rotational axis that is less than 10 degrees, such as less than 5 degrees. The rotor casing 2 having the two frustoconical portions 10 and 11 with imaginary apexes pointing downwards allows for the insert 1 to be inserted into a rotatable member 30 from above. Thus, the shape of the outer surface increases the compatibility with an external rotatable member 30, which may engage the whole, or part of the outer surface of the rotor casing 2, such as engage the first 10 and second 11 frustoconical portions.

There is a lower rotatable seal arranged within lower seal housing 12 which separates the rotor casing 2 from the first stationary portion 3 and an upper rotatable seal arranged within upper seal housing 13 which separates the rotor casing 2 from the second stationary portion 4. The axial position of the sealing interface within the lower seal housing 12 is denoted 15*c*, and the axial position of the sealing interface within the upper seal housing 13 is denoted 16*c*. Thus, the sealing interfaces formed between such stationary part 15*a*, 16*a* and rotatable part 15*b*, 16*b* of the first 15 and second 16 rotatable seals also form the interfaces or border between the rotor casing 2 and the first 15 and second 16 stationary portions of the insert 1.

There are further a seal fluid inlet 15*d* and a seal fluid outlet 15*e* for supplying and withdrawing a seal fluid, such as a cooling liquid, to the first rotatable seal 15 and in analogy, a seal fluid inlet 16*d* and a seal fluid outlet 16*e* for supplying and withdrawing a seal fluid, such as a cooling liquid, to the second rotatable seal 16.

Shown in FIG. 1 is also the axial positions of the separation space 17 enclosed within the rotor casing 2. In this embodiment, the separation space is substantially positioned within the second frustoconical portion 11 of the rotor casing 2. The heavy phase collection space 17*c* of the separation space 17 extends from a first, lower, axial position 17*a* to a second, upper, axial position 17*b*. The inner peripheral surface of the separation space 17 may form an angle with the rotational axis (X) that is substantially the same as angle $\alpha$, i.e. the angle between the outer surface of the second frustoconical portion 11 and the rotational axis (X). The inner diameter of the separation space 17 may thus increase continuously from the first axial position 17*a* to the second axial position 17*b*. Angle $\alpha$ may be less than 10 degrees, such as less than 5 degrees.

The exchangeable separation insert 1 has a compact form that increases the manoeuvrability and handling of the insert 1 by an operator. As an example, the axial distance between the separation space 17 and the first stationary portion 3 at the lower axial end 5 of the insert may be less than 20 cm, such as less than 15 cm. This distance is denoted d1 in FIG. 1, and is in this embodiment the distance from the lowest axial position 17*a* of the heavy phase collection space 17*c* of the separation space 17 to the sealing interface 15*c* of the first rotatable seal 15. As a further example, if the separation space 17 comprises a stack of frustoconical separation discs, the frustoconical separation disc that is axially lowest in the stack and closest to the first stationary portion 3, may be arranged with the imaginary apex 18 positioned at an axial distance d2 from the first stationary portion 3 that is less than 10 cm, such as less than 5 cm. Distance d2 is in this embodiment the distance from the imaginary apex 18 of the axially lowermost separation disc to the sealing interface of the first rotatable seal 15.

Figure 2:
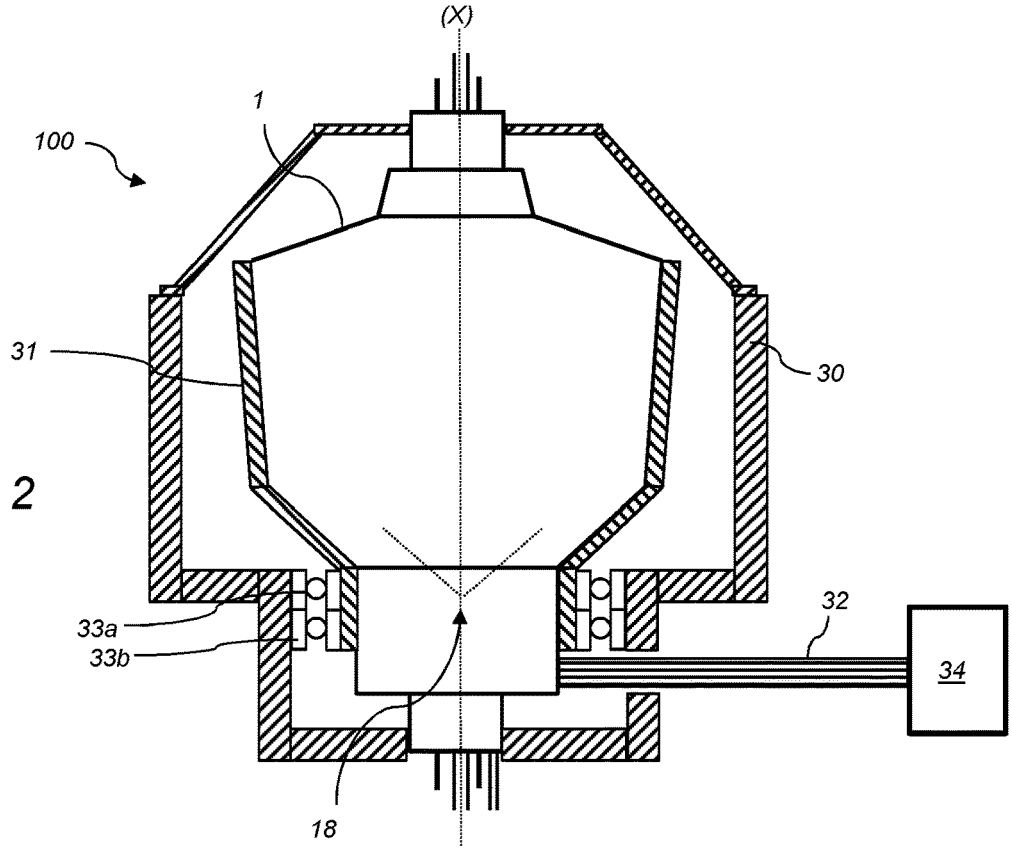
FIG. 2 is a schematic section of a centrifugal separator comprising an exchangeable insert according to the present disclosure.

FIG. 2 shows a schematic drawing of the exchangeable separation insert 1 being inserted within centrifugal separator 100, which comprises a stationary frame 30 and a rotatable member 31 that is supported by the frame by means of supporting means in the form of an upper and lower ball bearing 33*a*, 33*b*. There is also a drive unit 34, which in this case is arranged for rotating the rotatable member 31 around the axis of rotation 31 via drive belt 32. However, other driving means are possible, such as an electrical direct drive.

The exchangeable separation insert 1 is inserted and secured within rotatable member 31. The rotatable member 31 thus comprises a through hole with an inner surface for engaging with the outer surface of the rotor casing 2. That is, the rotor casing 2 of the insert 1 is secured within the rotatable member 31. The first and second stationary portions 3, 4 extend out of the roatable member 31 and are secured in the centrifugal separator 100.

After mounting of the insert 1, the upper and lower ball bearings 33*a*, 33*b* are both positioned axially below the separation space 17 within the rotor casing 2 such that the cylindrical portion 14 of the outer surface of the rotor casing 2 is positioned axially at the bearing planes. The cylindrical portion 14 thus facilitates mounting of the insert within at least one large ball bearing. The upper and lower ball bearings 33*a*, 33*b* may have an inner diameter of at least 80 mm, such as at least 120 mm.

Further, as seen in FIG. 2, the insert 1 is positioned within rotatable member 31 such that the imaginary apex 18 of the lowermost separation disc is positioned axially at or below at least one bearing plane of the upper and lower ball bearings 33*a*, 33*b*.

Moreover, the separation insert is mounted within the separator 1 such that the axial lower part 5 of the insert 1 is positioned axially below the supporting means, i.e. the upper and lower bearings 33*a*, 33*b*. The rotor casing 2 is in this example arranged to be solely externally supported by the rotatable member 31. The separation insert 1 is further mounted within the separator 100 to allow easy access to the inlet and outlets at the top and bottom of the insert 1.

Figure 3:
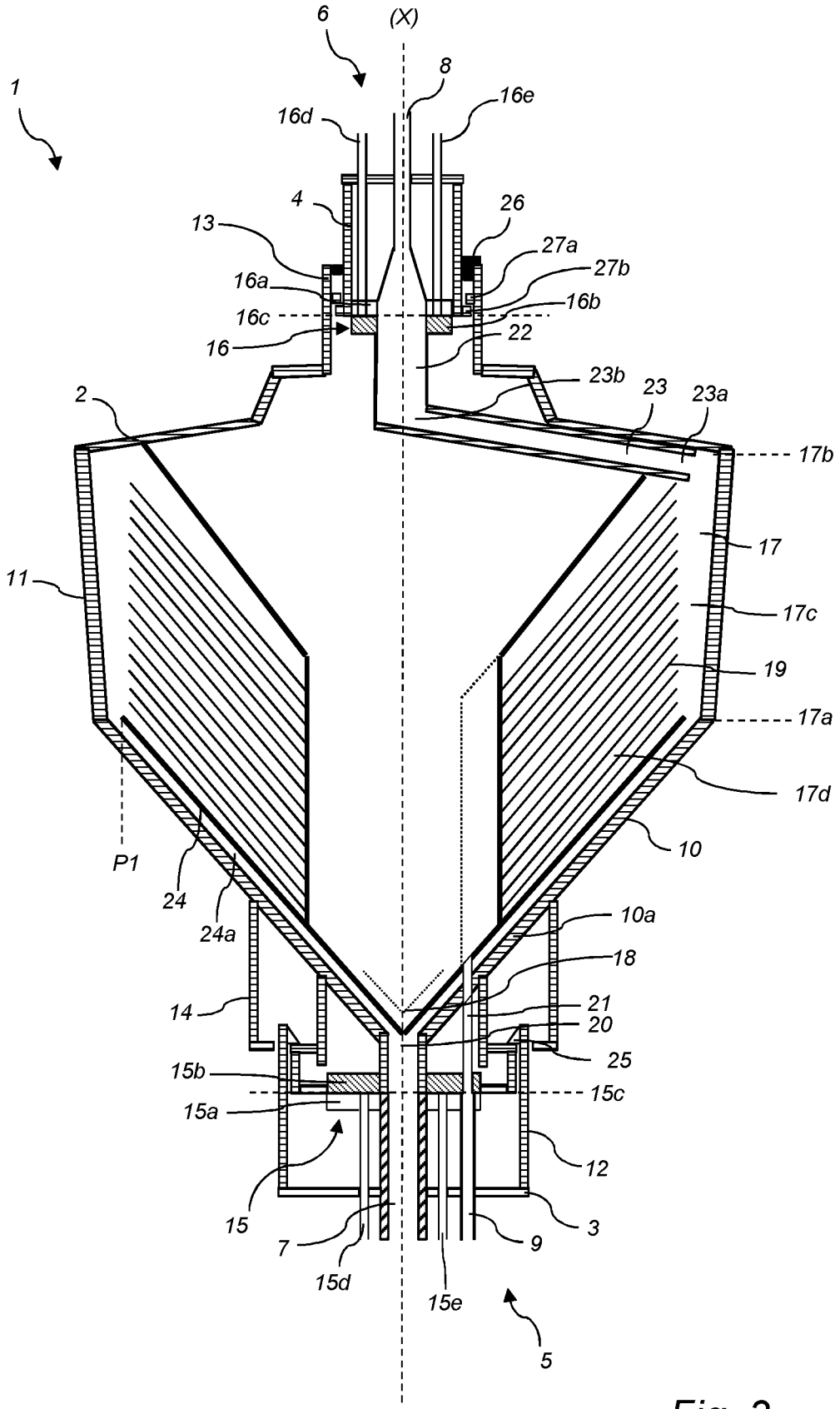
FIG. 3 is a schematic section view of an exchangeable separation insert according to the present disclosure.

FIG. 3 shows a schematic illustration of cross-section of an embodiment of exchangeable separation insert 1 of the present disclosure. The insert 1 comprises a rotor casing 2 arranged to rotate around rotational axis (X), a first, lower stationary portion 3, and a second, upper stationary portion 4. The rotor casing 1 is arranged between the first, stationary portion 3 and the second stationary portion 4. The first stationary portion 3 is thus arranged at the lower axial end 5 of the insert, whereas the second stationary portion 4 is arranged at the upper axial end 6 of the insert 1.

The feed inlet 20 is in this example arranged at the axial lower end 5, and the feed is supplied via a stationary inlet conduit 7 arranged in the first stationary portion 3. The stationary inlet conduit 7 may comprise a tubing, such as a plastic tubing. The stationary inlet conduit 7 is arranged at the rotational axis (X) so that the material to be separated is supplied at the rotational centre. The feed inlet 20 is for receiving the fluid mixture to be separated.

The feed inlet 20 is in this embodiment arranged at the apex of an inlet cone 10*a*, which on the outside of the insert 1 also forms the first frustoconical outer surface 10. There is further a distributor 24 arranged in the feed inlet 20 for distributing the fluid mixture from the inlet 24 to the separation space 17.

The separation space 17 comprises an outer heavy phase collection space 17*c* that extends axially from a first, lower axial position 17*a* to a second, upper axial position 17*b*. The separation space 17 further comprises a radially inner space formed by the interspaces between the separation discs of the stack 19.

The distributor 24 has in this embodiment a conical outer surface with the apex at the rotational axis (X) and pointing toward the lower end 5 of the insert 1. The outer surface of the distributor 24 has the same conical angle as the inlet cone 10*a*. There is further a plurality of distributing channels 24*a* extending along the outer surface for guiding the fluid mixture to be separated continuously axially upwards from an axially lower position at the inlet to an axially upper position separation space 17. This axially upper position is substantially the same as the first, lower axial position 17*a* of the heavy phase collection space 17*c* of the separation space 17. The distribution channels 24*a* may for example have a straight shape or a curved shape, and thus extend between the outer surface of the distributor 24 and the inlet cone 24*a*. The distribution channels 24 may be diverging from an axial lower position to an axial upper position. Furthermore, the distribution channels 24 may be in the form of tubes extending from an axial lower position to an axial upper position.

There is further a stack 19 of frustoconical separation discs arranged coaxially in the separation space 17. The separation discs in the stack 19 are arranged with the imaginary apex pointing to the axially lower end 5 of the separation insert, i.e. towards the inlet 20. The imaginary apex 18 of the lowermost separation disc in the stack 19 may be arranged at a distance that is less than 10 cm from the first stationary portion 3 in the axial lower end 5 of the insert 1. The stack 19 may comprise at least 20 separation discs, such as at least 40 separation discs, such as at least 50 separation discs, such as at least 100 separation discs, such as at least 150 separation discs. For clarity reasons, only a few discs are shown in FIG. 1. In this example, the stack 19 of separation discs is arranged on top of the distributor 24, and the conical outer surface of the distributor 24 may thus have the same angle relative the rotational axis (X) as the conical portion of the frustoconical separation discs. The conical shape of the distributor 24 has a diameter that is about the same or larger than the outer diameter of the separation discs in the stack 19. Thus, the distribution channels 24*a* may thus be arranged to guide the fluid mixture to be separated to an axially outer position 17*a* in the separation space 17 that is at a radial position $P_1$ that is outside the radial position of the outer circumference of the frustoconical separation discs in the stack 19.

The heavy phase collection space 17*c* of the separation space 17 has in this embodiment an inner diameter that continuously increases from the first, lower axial position 17*a* to the second, upper axial position 17*b*. There is further an outlet conduit 23 for transporting a separated heavy phase from the separation space 17. This conduit 23 extends from a radially outer position of the separation space 17 to the heavy phase outlet 22. In this example, the conduit is in the form of a single pipe extending from a central position radially out into the separation space 17. However, there may be at least two such outlet conduits 23, such as at least three, such as at least five, outlet conduits 23. The outlet conduit 23 has thus a conduit inlet 23*a* arranged at the radially outer position and a conduit outlet 23*b* at a radially inner position, and the outlet conduit 23 is arranged with an upward tilt from the conduit inlet 23*a* to the conduit outlet 23*b*. As an example, the outlet conduit may be tilted with an upward tilt of at least 2 degrees, such as at least five degrees, such as at least ten degrees, relative the radial plane.

The outlet conduit 23 is arranged at an axially upper position in the separation space 17, such that the outlet conduit inlet 23*a* is arranged for transporting separated heavy phase from the axially uppermost position 17*b* of the separation space 17. The outlet conduit 23 further extends radially out into the separation space 17 so that outlet conduit inlet 23*a* is arranged for transporting separated heavy phase from the periphery of the separation space 17, i.e. from the radially outermost position in the separation space at the inner surface of the separation space 17.

The conduit outlet 23*b* of the stationary outlet conduit 23 ends at the heavy phase outlet 22, which is connected to a stationary outlet conduit 8 arranged in the second, upper stationary portion 4. Separated heavy phase is thus discharged via the top, i.e. at the upper axial end 6, of the separation insert 1.

Furthermore, separated liquid light phase, which has passed radially inwards in the separation space 17 through the stack of separation discs 19, is collected in the liquid light phase outlet 21 arranged at the axially lower end of the rotor casing 2. The liquid light phase outlet 21 is connected to a stationary outlet conduit 9 arranged in the first, lower stationary portion 3 of the insert 1. Thus, separated liquid light phase is discharged via the first, lower, axial end 5 of the exchangeable separation insert 1.

The stationary outlet conduit 9 arranged in the first stationary portion 3 and the stationary heavy phase conduit 8 arranged in the second stationary portion 4 may comprise tubing, such as plastic tubing.

There is a lower rotatable seal 15, which separates the rotor casing 2 from the first stationary portion 3, arranged within lower seal housing 12 and an upper rotatable seal, which separates the rotor casing 2 from the second stationary portion 4, arranged within upper seal housing 13. The first 15 and second 16 rotatable seals are hermetic seals, thus forming mechanically hermetically sealed inlet and outlets.

The lower rotatable seal 15 may be attached directly to the inlet cone 10*a* without any additional inlet pipe, i.e. the inlet may be formed at the apex of the inlet cone directly axially above the lower rotatable seal 15. Such an arrangement enables a firm attachment of the lower mechanical seal at a large diameter to minimize axial run-out.

The lower rotatable seal 15 seals and connects both the inlet 20 to the stationary inlet conduit 7 and seals and connects the liquid light phase outlet 21 to the stationary liquid light phase conduit 9. The lower rotatable 15 seal thus forms a concentric double mechanical seal, which allows for easy assembly with few parts. The lower rotatable seal 15 comprises a stationary part 15*a* arranged in the first stationary portion 3 of the insert 1 and a rotatable part 15*b* arranged in the axially lower portion of the rotor casing 2. The rotatable part 15*b* is in this embodiment a rotatable sealing ring arranged in the rotor casing 2 and the stationary part 15*a* is a stationary sealing ring arranged in the first stationary portion 3 of the insert 1. There are further means (not shown), such as at least one spring, for bringing the rotatable sealing ring and the stationary sealing ring into engagement with each other, thereby forming at least one sealing interface 15*c* between the rings. The formed sealing interface extends substantially in parallel with the radial plane with respect to the axis of rotation (X). This sealing interface 15*c* thus forms the border or interface between the rotor casing 2 and the first stationary portion 3 of the insert 1. There are further connections 15*d* and 15*e* arranged in the first stationary portion 3 for supplying a liquid, such as a cooling liquid, buffer liquid or barrier liquid, to the lower rotatable seal 15. This liquid may be supplied to the interface 15*c* between the sealing rings.

In analogy, the upper rotatable seal 16 seals and connects the heavy phase outlet 22 to the stationary outlet conduit 8. The upper mechanical seal may also be a concentric double mechanical seal. The upper rotatable seal 16 comprises a stationary part 16*a* arranged in the second stationary portion 4 of the insert 1 and a rotatable part 16*b* arranged in the axially upper portion of the rotor casing 2. The rotatable part 16*b* is in this embodiment a rotatable sealing ring arranged in the rotor casing 2 and the stationary part 16*a* is a stationary sealing ring arranged in the second stationary portion 4 of the insert 1. There are further means (not shown), such as at least one spring, for bringing the rotatable sealing ring and the stationary sealing ring into engagement with each other, thereby forming at least one sealing interface 16*c* between the rings. The formed sealing interface 16*c* extends substantially in parallel with the radial plane with respect to the axis of rotation (X). This sealing interface 16*c* thus forms the border or interface between the rotor casing 2 and the second stationary portion 4 of the insert 1. There are further connections 16*d* and 16*e* arranged in the second stationary portion 4 for supplying a liquid, such as a cooling liquid, buffer liquid or barrier liquid, to the upper rotatable seal 16. This liquid may be supplied to the interface 16*c* between the sealing rings.

Furthermore, FIG. 3 shows the exchangeable separation insert in a transport mode. In order to secure the first stationary portion 3 to the rotor casing 2 during transport, there is a lower securing means 25 in the form of a snap fit that axially secures the lower rotatable seal 15 to the cylindrical portion 14 of rotor casing 2. Upon mounting the exchangeable insert 1 in a rotating assembly, the snap fit 25 may be released such that the rotor casing 2 becomes rotatable around axis (X) at the lower rotatable seal.

Moreover, during transport, there is an upper securing means 27*a, b* that secures the position of the second stationary portion 4 relative the rotor casing 2. The upper securing means is in the form of an engagement member 27*a* arranged on the rotor casing 2 that engages with an engagement member 27*b* on the second stationary portion 4, thereby securing the axial position of the second stationary portion 4. Further, there is a sleeve member 26 arranged in a transport or setup position in sealing abutment with the rotor casing 2 and the second stationary portion 4. The sleeve member 26 is further resilient and may be in the form of a rubber sleeve. The sleeve member is removable from the transport or setup position for permitting the rotor casing 2 to rotate in relation to the second stationary portion 4. Thus, the sleeve member 26 seals radially against the rotor casing 2 and radially against the second stationary portion 4 in the setup or transport position. Upon mounting the exchangeable insert 1 in a rotating assembly, the sleeve member may be removed and an axial space between engagement members 27*a* and 27*b* may be created in order to allow rotation of the rotor casing 2 relative the second stationary portion 4.

The lower and upper rotatable seals 15,16 are mechanical seals, hermetically sealing the inlet and the two outlets.

During operation, the exchangeable separation insert 1, inserted into a rotatable member 31, is brought into rotation around rotational axis (X). Liquid mixture to be separated is supplied via stationary inlet conduit 7 to the inlet 20 of the insert, and is then guided by the guiding channels 24 of the distributor 24 to the separation space 17. Thus, the liquid mixture to be separated is guided solely along an axially upwards path from the inlet conduit 7 to the separation space 17. Due to a density difference the liquid mixture is separated into a liquid light phase and a liquid heavy phase. This separation is facilitated by the interspaces between the separation discs of the stack 19 fitted in the separation space 17. The separated liquid heavy phase is collected from the periphery of the separation space 17 by outlet conduit 22 and is forced out via the heavy phase outlet 22 arranged at the rotational axis (X) to the stationary heavy phase outlet conduit 8. Separated liquid light phase is forced radially inwards through the stack 19 of separation discs and led via the liquid light phase outlet 21 out to the stationary light phase conduit 9.

Consequently, in this embodiment, the feed is supplied via the lower axial end 5, the separated light phase is discharged via the lower axial end 5, whereas the separated heavy phase is discharged via the upper axial end 6.

Further due to the arrangement of the inlet 20, distributor 24, stack 19 of separation discs and the outlet conduit 23 as disclosed above, the exchangeable separation insert 1 is de-aerated automatically, i.e. the presence of air-pockets is eliminated or decreased so that any air present within the rotor casing is forced to travel unhindered upwards and out via the heavy phase outlet. Thus, at stand-still, there are no air pockets, and if the insert 1 is filled up through the feed inlet all air may be vented out through the heavy phase outlet 22. This also facilitates filling the separation insert 1 at standstill and start rotating the rotor casing when liquid mixture to be separated or buffer fluid for the liquid mixture is present within the insert 1.

As also seen in FIG. 3, the exchangeable separation insert 1 has a compact design. As an example, the axial distance between the imaginary apex 18 of the lowermost separation disc in the stack 19 may be less than 10 cm, such as less than 5 cm, from the first stationary portion 3, i.e. less than 10 cm, such as less than 5 cm, from the sealing interface 15*c* of the lower rotatable seal 15.

Figure 4:
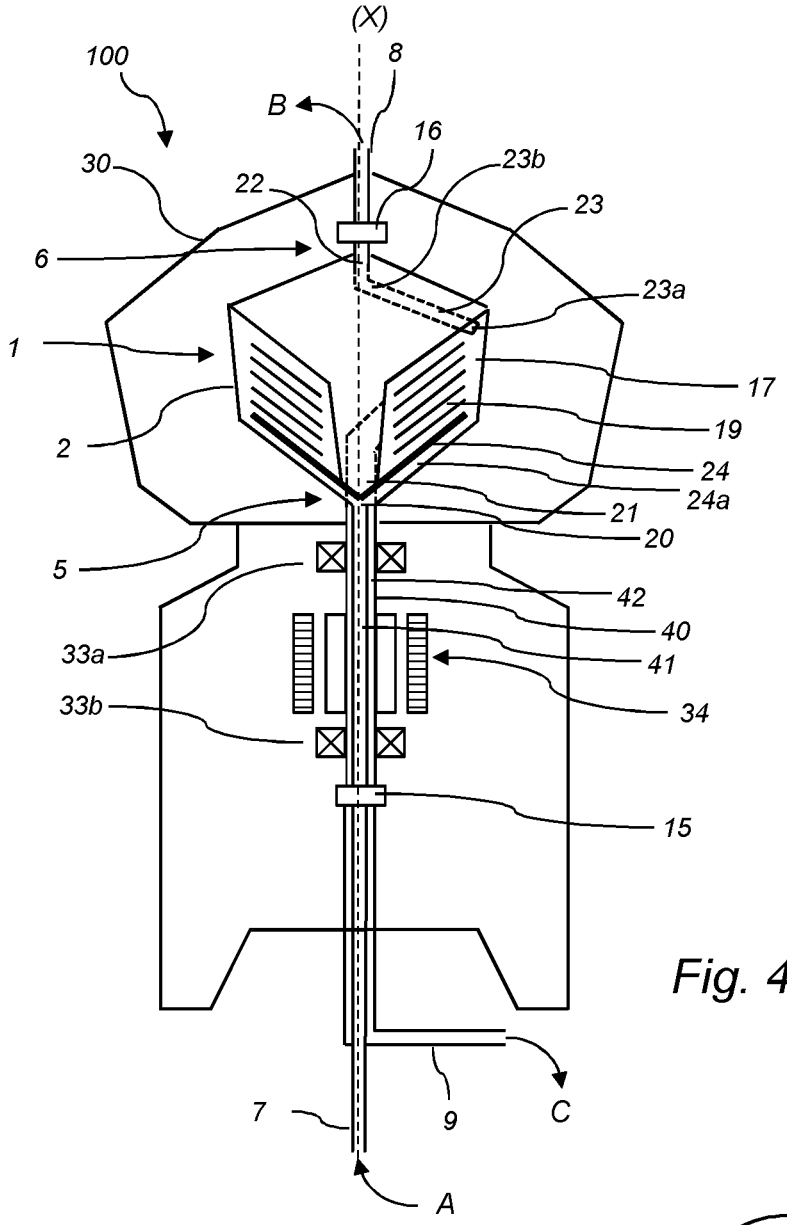
FIG. 4. is a schematic illustration of a centrifugal separator comprising a centrifugal separator bowl according to the present disclosure.

FIG. 4 shows an example of a centrifugal separator 100 comprising a centrifugal separator bowl 1 of the present disclosure. The centrifugal separator 100 may be for separating a cell culture mixture. The separator 100 comprises a frame 30, a hollow spindle 40, which is rotatably supported by the frame 30 in a bottom bearing 33*b* and a top bearing 33*a*, and a centrifugal separator bowl 1 having a rotor casing 2. The rotor casing 2 is adjoined to the axially upper end of the spindle 40 to rotate together with the spindle 40 around the axis (X) of rotation. The rotor casing 2 encloses a separation space 17 in which a stack 19 of separation discs is arranged in order to achieve effective separation of a liquid mixture that is processed. The separation discs of the stack 19 have a frustoconical shape with the imaginary apex pointing axially downwards and are examples of surface-enlarging inserts. The stack 19 is fitted centrally and coaxially with the rotor casing 2. In FIG. 4, only a few separation discs are shown. The stack 19 may for example contain above 100 separation discs, such as above 200 separation discs.

The rotor casing 2 has a mechanically hermetically sealed liquid outlet 21 for discharge of a separated liquid light phase, and a heavy phase outlet 22 for discharge of a phase of higher density than the separated liquid light phase. There is a single outlet conduit 23 in the form of a pipe for transporting separated heavy phase from the separation space 17. This conduit 23 extends from a radially outer position of the separation space 17 to the heavy phase outlet 22. The conduit 23 has a conduit inlet 23*a* arranged at the radially outer position and a conduit outlet 23*b* arranged at a radially inner position. Further the outlet conduit 23 is arranged with an upward tilt relative the radial plane from the conduit inlet 23*a* to the conduit outlet 23*b*.

There is also a mechanically hermetically sealed inlet 20 for supply of the liquid mixture to be processed to said separation space 17. The inlet 20 is in this embodiment connected to a central duct 41 extending through the spindle 40, which thus takes the form of a hollow, tubular member. Introducing the liquid material from the bottom provides a gentle acceleration of the liquid material. The spindle 40 is further connected to a stationary inlet pipe 7 at the bottom axial end of the separator 100 via a hermetic seal 15, such that the liquid mixture to be separated may be transported to the central duct 41, e.g. by means of a pump. The separated liquid light phase is in this embodiment discharged via an outer annular duct 42 in said spindle 40. Consequently, the separated liquid phase of lower density is discharged via the bottom of the separator 100.

A first mechanical hermetic seal 15 is arranged at the bottom end to seal the hollow spindle 40 to the stationary inlet pipe 7. The hermetic seal 15 is an annular seal that surrounds the bottom end of the spindle 40 and the stationary pipe 7. The first hermetic seal 15 is a concentric double seal that seals both the inlet 21 to the stationary inlet pipe 7 and the liquid light phase outlet 21 to a stationary outlet pipe 9. There is also a second mechanical hermetic seal 16 that seals the heavy phase outlet 22 at the top of the separator 100 to a stationary outlet pipe 8.

As seen in FIG. 4, the inlet 20, and the heavy phase outlet 22 as well as the stationary outlet pipe 8 for discharging separated heavy phase are all arranged around rotational axis (X) so that liquid mixture to be separated enters said rotor casing 2 at the rotational axis (X), as indicated by arrow "A", and the separated heavy phase is discharged at the rotational axis (X), as indicated by arrow "B". The discharged liquid light phase is discharged at the bottom end of the centrifugal separator 100, as illustrated by arrow "C".

The centrifugal separator 100 is further provided with a drive motor 34. This motor 34 may for example comprise a stationary element and a rotatable element, which rotatable element surrounds and is connected to the spindle 40 such that it transmits driving torque to the spindle 40 and hence to the rotor casing 2 during operation. The drive motor 34 may be an electric motor. Furthermore, the drive motor 34 may be connected to the spindle 40 by transmission means. The transmission means may be in the form of a worm gear which comprises a pinion and an element connected to the spindle 40 in order to receive driving torque. The transmission means may alternatively take the form of a propeller shaft, drive belts or the like, and the drive motor 34 may alternatively be connected directly to the spindle 40.

During operation of the separator in FIG. 4, the centrifugal separator bowl 1 and rotor casing 2 are caused to rotate by torque transmitted from the drive motor 34 to the spindle 40. Via the central duct 41 of the spindle 40, liquid mixture to be separated is brought into the separation space 17 via inlet 20. The inlet 20 and the stack 19 of separation discs are arranged so that the liquid mixture enters the separation space 19 at a radial position that is at, to or radially outside, the outer radius of the stack 19 of separation discs.

In the hermetic type of inlet 20, the acceleration of the liquid material is initiated at a small radius and is gradually increased while the liquid leaves the inlet and enters the separation space 17. The separation space 17 is intended to be completely filled with liquid during operation. In principle, this means that preferably no air or free liquid surfaces is meant to be present within the rotor casing 2.

However, liquid mixture may be introduced when the rotor is already running at its operational speed or at standstill. Liquid mixture may thus be continuously introduced into the rotor casing 2.

Due to a density difference, the liquid mixture is separated into a liquid light phase and a heavy phase. This separation is facilitated by the interspaces between the separation discs of the stack 19 fitted in the separation space 17. The separated heavy phase is collected from the periphery of the separation space 17 by conduit 23 and forced out through outlet 22 arranged at the rotational axis (X), whereas separated liquid light phase is forced radially inwards through the stack 19 and then led out through the annular outer duct 42 in the spindle 40.

Figure 5:
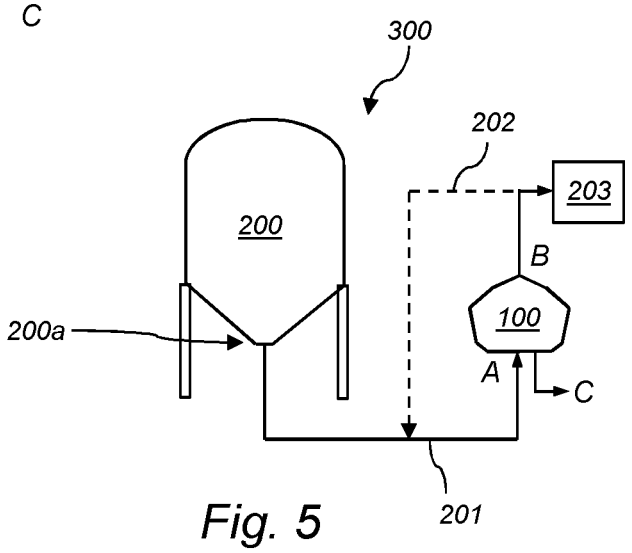
FIG. 5. is a schematic illustration of a system for separating a cell culture mixture.

FIG. 5 is a schematic illustration of a system 300 for separating a cell culture mixture. The system comprises a fermenter tank 200 in which comprises a cell culture mixture. The fermenter tank 200 has an axially upper portion and an axially lower portion 200*a*. The fermentation may for example be for expression of an extracellular biomolecule, such as an antibody, from a mammalian cell culture mixture. After fermentation, the cell culture mixture is separated in a centrifugal separator 100 according to the present disclosure. As seen in FIG. 5, the bottom of the fermenter tank 200 is connected via a connection 201 to the bottom of the separator 100, which may thus decrease the footprint and the complexity of the system 300. The connection 201 may be a direct connection or a connection via any other processing equipment, such as a tank. Thus, the connection 201 allows for supply of the cell culture mixture from the axially lower portion 200*a* of the fermenter tank 200 to the inlet at the axially lower end of the centrifugal separator 100, as indicated by arrow "A". After separation, the separated cell phase of higher density is discharged at the top of the separator, as indicated by arrow "B", whereas the separated liquid light phase of lower density, comprising the expressed biomolecule, is discharged via the liquid light phase outlet at the bottom of the separator 100, as indicated by arrow "C". The separated cell phase may be discharged to a tank 203 for re-use in a subsequent fermentation process, e.g. in the fermenter tank 200. The separated cell phase may further be recirculated to the feed inlet of the separator 100, as indicated by connection 202. The separated liquid light phase may be discharged to further process equipment for subsequent purification of the expressed biomolecule.

In the above the inventive concept has mainly been described with reference to a limited number of examples. However, as is readily appreciated by a person skilled in the art, other examples than the ones disclosed above are equally possible within the scope of the inventive concept, as defined by the appended claims.

The invention claimed is:

1. A centrifugal separator bowl comprising:

a rotor casing enclosing a separation space in which a stack of frustoconical separation discs is arranged, the rotor casing being arranged to rotate around a vertical axis of rotation, wherein the separation discs are arranged with the imaginary apex pointing to the axially lower end of the rotor casing;

a feed inlet at the axially lower end for receiving a fluid mixture to be separated;

a distributor for distributing the fluid mixture from the inlet to the separation space, said distributor being arranged for guiding the fluid mixture to be separated continuously from an axially lower position at the inlet to an axially upper position in the separation space;

a light phase outlet for discharge of a separated phase of a first density and a heavy phase outlet for discharge of a separated phase of a second density higher than said first density, said heavy phase outlet being arranged at the axially upper end of the rotor casing; and at least one outlet conduit for transporting separated phase of the second density from the separation space, said conduit extending from a radially outer position of said separation space to said heavy phase outlet; said conduit having a conduit inlet arranged at the radially outer position and a conduit outlet at a radially inner position, wherein the imaginary apex points toward the feed inlet at the axially lower end of the rotor casing.

2. The centrifugal separator bowl according to claim 1, wherein the feed inlet is at the rotational axis.

3. The centrifugal separator bowl according to claim 1, further comprising a mechanical hermetic seal for sealing said inlet to a stationary inlet pipe.

4. The centrifugal separator bowl according to claim 1, wherein the distributor and the inlet are arranged to guide the fluid mixture to be separated solely along an upwards path from a stationary inlet conduit to the separation space.

5. The centrifugal separator bowl according to claim 1, wherein the distributor is arranged to guide the fluid mixture to an axially upper position in the separation space, which is at a radial position that is outside the radial position of the outer circumference of the stack of frustoconical separation discs.

6. The centrifugal separator bowl according to claim 1, wherein the stack of separation discs forms a stack on top of the distributor.

7. The centrifugal separator bowl according to claim 1, wherein the distributor has a conical outer surface with the apex pointing toward the axially lower end of the centrifugal separator bowl.

8. The centrifugal separator bowl according to claim 7, wherein the distributor comprises distribution channels extending along the outer surface of the distributor.

9. The centrifugal separator bowl according to claim 1, wherein the at least one outlet conduit is arranged with an upward tilt from the conduit inlet to the conduit outlet.

10. The centrifugal separator bowl according to claim 1, wherein the separator bowl forms part of an exchangeable separation insert for a centrifugal separator.

11. The centrifugal separator bowl according to claim 1, further comprising a spindle arranged to rotate coaxially with said separator bowl and further arranged to be rotatably supported by a stationary frame.

12. A method of separating a liquid mixture comprising:

a. providing a centrifugal separator comprising the centrifugal separator bowl according to claim 1;

b. supplying a liquid to said feed inlet at standstill and withdrawing liquid from said heavy phase outlet to eliminate any air-locks within said centrifugal separator bowl;

c. rotating said centrifugal separator bowl around the axis of rotation; and d. supplying said liquid mixture to be separated to said feed inlet.

13. The method according to claim 12, wherein the liquid mixture to be separated is a cell culture mixture.

14. The method according to claim 13, wherein the liquid supplied in step b) is buffer liquid for the cell culture mixture.

15. The method according to claim 12, wherein the liquid supplied in step b) is the liquid mixture to be separated.

16. The centrifugal separator bowl according to claim 2, further comprising a mechanical hermetic seal for sealing said inlet to a stationary inlet pipe.

17. The centrifugal separator bowl according to claim 2, wherein the distributor is arranged to guide the fluid mixture to an axially upper position in the separation space, which is at a radial position that is outside the radial position of the outer circumference of the stack of frustoconical separation discs.

18. The centrifugal separator bowl according to claim 3, wherein the distributor is arranged to guide the fluid mixture to an axially upper position in the separation space, which is at a radial position that is outside the radial position of the outer circumference of the stack of frustoconical separation discs.

19. The centrifugal separator bowl according to claim 1, wherein said light phase outlet is arranged at the axially lower end of the rotor casing.

20. A centrifugal separator bowl comprising:

a rotor casing enclosing a separation space in which a stack of frustoconical separation discs is arranged, the rotor casing being arranged to rotate around a vertical axis of rotation, wherein the separation discs are arranged with the imaginary apex pointing to the axially lower end of the rotor casing;

a feed inlet at the axially lower end for receiving a fluid mixture to be separated;

a distributor for distributing the fluid mixture from the inlet to the separation space, said distributor being arranged for guiding the fluid mixture to be separated continuously from an axially lower position at the inlet to an axially upper position in the separation space;

a light phase outlet for discharge of a separated phase of a first density and a heavy phase outlet for discharge of a separated phase of a second density higher than said first density, said heavy phase outlet being arranged at the axially upper end of the rotor casing; and at least one outlet conduit for transporting separated phase of the second density from the separation space, said conduit extending from a radially outer position of said separation space to said heavy phase outlet said conduit having a conduit inlet arranged at the radially outer position and a conduit outlet at a radially inner position, wherein the at least one outlet conduit is arranged with an upward tilt from the conduit inlet to the conduit outlet, and wherein the at least one outlet conduit is tilted with an upward tilt of at least 2 degrees relative the radial plane.

* * * * *